US007900337B2

(12) United States Patent
Crowley

(10) Patent No.: US 7,900,337 B2
(45) Date of Patent: Mar. 8, 2011

(54) METHOD OF MAKING COMPOSITE ACOUSTIC TRANSDUCERS

(75) Inventor: Robert J. Crowley, Sudbury, MA (US)

(73) Assignee: Shure Incorporated, Niles, IL (US)

( * ) Notice: Subject to any disclaimer, the term of this patent is extended or adjusted under 35 U.S.C. 154(b) by 579 days.

(21) Appl. No.: 11/242,612

(22) Filed: Oct. 3, 2005

(65) Prior Publication Data

US 2008/0152186 A1 Jun. 26, 2008

Related U.S. Application Data

(60) Provisional application No. 60/620,934, filed on Oct. 21, 2004.

(51) Int. Cl.
*H04R 31/00* (2006.01)

(52) U.S. Cl. ..... 29/594; 29/592.1; 29/609.1; 310/334; 310/369; 381/176; 381/399

(58) Field of Classification Search ..... 29/25.35, 29/600, 738, 592.1, 594, 609.1; 310/334, 310/369; 381/176, 399
See application file for complete search history.

(56) References Cited

U.S. PATENT DOCUMENTS

| | | | | |
|---|---|---|---|---|
| 1,885,001 | A | | 10/1932 | Olson |
| 1,892,645 | A | | 12/1932 | Olson et al. |
| 2,173,219 | A | | 9/1939 | Anderson |
| 2,230,104 | A | | 1/1941 | Bostwick |
| 2,305,599 | A | | 12/1942 | Bauer |
| 2,361,656 | A | | 10/1944 | Rogers |
| 2,527,344 | A | | 10/1950 | Anderson |
| 2,539,671 | A | | 1/1951 | Olson |
| 2,673,251 | A | | 3/1954 | Duncan |
| 2,699,474 | A | | 1/1955 | Olson |
| 2,963,557 | A | | 12/1960 | Anderson |
| 3,435,143 | A | | 3/1969 | Fisher |
| 3,564,163 | A | * | 2/1971 | Hobrough ..... 381/399 |
| 3,619,517 | A | | 11/1971 | Bleazey |
| 3,832,499 | A | * | 8/1974 | Heil ..... 381/408 |
| 4,001,523 | A | | 1/1977 | Kasatkin et al. |
| 4,281,223 | A | | 7/1981 | Ugaji et al. |
| 4,319,096 | A | | 3/1982 | Winey |
| 4,395,592 | A | | 7/1983 | Colangelo |
| 4,406,059 | A | | 9/1983 | Scott et al. |

(Continued)

FOREIGN PATENT DOCUMENTS

EP 1318706 A1 * 11/2003

(Continued)

OTHER PUBLICATIONS

International Search Report for PCT/US2005/35702, dated Nov. 27, 2006.

(Continued)

*Primary Examiner* — C. J Arbes
(74) *Attorney, Agent, or Firm* — Banner & Witcoff, Ltd.

(57) ABSTRACT

A composite membrane acoustic transducer structure comprising a magnet assembly is arranged adjacent the composite membrane material. The magnet assembly is arranged to produce a flux field. A first layer of thin, elongate composite membrane material is held under tension. A second conductive layer is attached to the first layer of composite membrane material wherein the first and second layers of membrane material are arranged adjacent, generally parallel and offset from the magnet assembly. The assembly is arranged to produce the flux field through at least part of the first layer and the second layer.

17 Claims, 11 Drawing Sheets

U.S. PATENT DOCUMENTS

| | | | | |
|---|---|---|---|---|
| 4,413,160 | A | 11/1983 | Ohyaba et al. | |
| 4,460,060 | A | 7/1984 | Hasumi et al. | |
| 4,473,723 | A * | 9/1984 | Hobrough | 381/399 |
| 4,484,037 | A | 11/1984 | Nieuwendijk et al. | |
| 4,517,416 | A | 5/1985 | Goossens | |
| 4,580,014 | A * | 4/1986 | Hobrough | 381/399 |
| 4,809,578 | A | 3/1989 | Lace | |
| 5,021,613 | A | 6/1991 | Garcia | |
| 5,195,143 | A * | 3/1993 | Spiegel et al. | 381/399 |
| 5,212,736 | A | 5/1993 | Tsukagoshi | |
| 5,701,359 | A | 12/1997 | Guenther | |
| 5,982,905 | A | 11/1999 | Grodinsky | |
| 6,137,891 | A | 10/2000 | Porrazzo | |
| 6,285,769 | B1 | 9/2001 | Edelson | |
| 6,393,129 | B1 | 5/2002 | Conrad | |
| 6,434,252 | B1 * | 8/2002 | Royer et al. | 381/176 |
| 6,535,612 | B1 | 3/2003 | Croft | |
| 6,834,113 | B1 | 12/2004 | Liljehag | |
| 6,868,166 | B1 | 3/2005 | Zhang | |
| 6,925,191 | B2 | 8/2005 | Petroff et al. | |
| 6,956,953 | B2 | 10/2005 | Mazarakis | |
| 7,058,195 | B2 | 6/2006 | Trandafir | |
| 7,106,880 | B2 | 9/2006 | Bengtsson | |
| 7,116,796 | B1 * | 10/2006 | Reenberg | 381/431 |
| 7,136,496 | B2 * | 11/2006 | van Halteren et al. | 381/174 |
| 7,149,321 | B2 * | 12/2006 | Hutt et al. | 381/389 |
| 7,203,332 | B2 * | 4/2007 | Hutt et al. | 381/399 |
| 7,278,200 | B2 * | 10/2007 | Steere et al. | 29/594 |
| 7,302,748 | B2 | 12/2007 | Jiles | |
| 7,430,297 | B2 * | 9/2008 | Akino | 381/176 |
| 2002/0080991 | A1 | 6/2002 | Bengtsson | |
| 2003/0016116 | A1 * | 1/2003 | Blaha | 338/2 |
| 2005/0100181 | A1 | 5/2005 | Croft | |
| 2005/0244016 | A1 | 11/2005 | Norris | |
| 2006/0078135 | A1 | 4/2006 | Royer | |
| 2006/0078152 | A1 | 4/2006 | Royer | |
| 2007/0014427 | A1 | 1/2007 | Schafer | |
| 2008/0130939 | A1 | 6/2008 | Jiles | |

FOREIGN PATENT DOCUMENTS

| | | |
|---|---|---|
| WO | 99/55118 | 10/1999 |
| WO | 9955118 | 10/1999 |

OTHER PUBLICATIONS

Office Action dated Feb. 9, 2009 for U.S. Appl. No. 11/242,611, 11 pages.

Office Action dated Jun. 19, 2009 for U.S. Appl. No. 11/242,611, 25 pages.

Office Action dated Dec. 17, 2009 for U.S. Appl. No. 11/242,611, 29 pages.

Office Action dated Jun. 16, 2010 for U.S. Appl. No. 11/242,611, 30 pages.

Harry F. Olsen, Ribbon Velocity Microphones, Journal of the Audio Engineering Society, Jun. 1970, vol. 18, No. 3.

Graham Bank, M.O.J Hawksford, Comparison between the Measured and Computed Performance of Ribbon Loudspeakers, Presented at the 100th convention of the Audio Engineering Society Copenhagen, May 1996, Preprint 4210(J-7).

Shorter, D.E.L., Hardwood, H.D., The Design of a Ribbon Type Pressure-Gradient Microphone for Broadcast Transmission, British Broadcasting Corporation, Monograph No. 4, Dec. 1955, pp. 5-22.

Ericson, Lars M., et al., Macroscopic, Neat, Single-Walled Carbon Nanotube Fibers, Science, vol. 305, Sep. 3, 2004, pp. 1447-1450.

Notice of Allowance dated Oct. 29, 2010 for U.S. Appl. No. 11/242,611, 28 pages.

* cited by examiner

METHOD OF MAKING COMPOSITE ACOUSTIC TRANSDUCERS

BACKGROUND

One aspect of the invention relates to acoustic transducers and more particularly to ribbon and thin film transducers and composite membranes fabricated with thin film techniques that operate at various sound wavelengths, and is based upon U.S. Provisional Application Ser. No. 60/620,934, filed 21 Oct. 2004, incorporated herein by reference in its entirety.

Prior Art

Designers and manufacturers of microphones used for vocal and instrument recording in studio environments look for improved ways to provide accurate sound reproduction. It would be desirable to provide characteristics to favor particular types of sounds, such as voices, grand pianos, or woodwinds as well as general designs having lower noise, higher and less distorted output, and greater consistency and longevity.

Microphones generally use transducers that are configured either as the electrodynamic type, or more simply "dynamic", and ribbon, and condenser varieties. Of these three major transducer types used in microphones, the ribbon type is the focus of this invention, however certain improvements and principles that apply to microphones in general are also incorporated. Such transducers, which may include those utilized for medical imaging, may also be fabricated, used or improved utilizing the principles of the present invention.

Advancement of the microphone art could proceed more quickly if better materials and methods of fabrication could be employed, and if the microphones were assembled and tested using techniques adapted from advanced techniques developed by the semiconductor and medical device industry. Precise positioning of the moving element, closed loop feedback control of the tuning of that element, and statistical process control techniques that reduce piece to piece variability would improve device characteristics and quality and consistency. Close control of microphone characteristics allow artists and studio engineers to quickly arrive and maintain optimal settings for recording, which saves time and production costs by reducing the number of sound checks and retakes required.

Microphones that are suitable for use on sound stages and in other film and television production settings must be sensitive, robust, and reliable, but not sensitive to positioning or swinging on a boom arm. Such motion may cause wind damage or noise to the delicate ribbon that is suspended within a magnetic gap. Improvements to the strength and durability of that ribbon structure would permit greater application and use of this type of microphone. It would further be desirable to increase the ribbon conductivity, decrease the overall mass and strength of the ribbon without making it excessively stiff, thus improving output efficiency while adding toughness. Output efficiency should be high since that improves the signal to noise ratio and overall sensitivity of the microphone.

Microphones utilized for recording purposes must be accurate. Each microphone built in a series should ideally perform in an identical manner. This is not always the case with current microphone manufacture inasmuch there are certain variations in the assembly and tuning of such microphones that affect their ability to reproduce sound consistently. It would be desirable to overcome irregularities that produce these variations and have precise assembly and tuning methods that would result in more exact piece-to-piece performance consistency.

External air currents and wind, including airflow from a performer's voice or a musical instrument or an amplified speaker may be of high enough intensity to damage or distort the delicate internal ribbon used in the current art. It would be desirable to permit normal airflow and sounds to freely circulate within the microphone, which then would permit more accurate sound reproduction without attenuation, while at the same time limiting damaging air blasts that exceed a certain intensity level. Such an improvement would allow wider use of the ribbon type microphone.

One embodiment of the invention comprises a ribbonned microphone assembly, having adjustable sound receiving capabilities, including: a transducer having a surrounding flux frame for positioning at least two magnets adjacent a suspended ribbon between said magnets; an array of receiving apertures arranged in the flux frame; and at least one curved return ring positioned in the receiving apertures to create a return path for magnetic flux in the transducer. The flux frame may have parallel sides. The flux frame may have tapered sides. The flux frame preferably has side apertures thereon. The side apertures may be non-circular. The side apertures may be elongated and curvilinear.

Another embodiment of the invention includes a method of manufacturing a ribbon for a ribbon microphone, comprising one or more of the following steps comprising: providing a first form having an irregular predetermined ribbon engaging surface thereon; depositing a ribbon forming material on the ribbon engaging surface; and forming the microphone ribbon on the first form. The method may include as steps: providing a second form having an irregular predetermined ribbon engaging surface thereon which corresponds matingly to the irregular predetermined ribbon engaging surface of the first form; and sandwiching the ribbon forming material between the ribbon engaging surfaces of the first and second forms. The form may have its temperature controlled. The ribbon may be comprised of more than one material. The form may be comprised of a vapor deposition supportable material selected from the group comprised of aluminum, wax and a dissolvable material. Another embodiment of the invention also includes a method of tuning a ribbon for subsequent utilization of said ribbon in a ribbon microphone comprising one or more of the following steps: arranging a calibration member for adjustable supporting and calibrating of a microphone ribbon therewith; attaching a microphone ribbon to the calibration member, the ribbon having a predetermined pattern formed thereon; activating a variable frequency oscillator connected to a loudspeaker, the oscillator being set to a desired resonant frequency of the ribbon; adjusting the calibration member to tension the ribbon; and observing a maximum excursion of the ribbon which indicates a resonant peak. The ribbon may be installed into a transducer assembly in a ribbonned microphone.

Another embodiment of the invention includes a method for reducing sound propagation from a microphone support, comprising one or more of the following steps: arranging a plurality of ring-like spacer members as a support for a ribbonned microphone; interposing acoustically lossy material between adjacent spacer members; attaching a first end of the plurality of spacer members to a ribbonned microphone housing; and attaching a second end of the spacer members to a microphone stand. The spacer members are preferably of annular shape.

Another embodiment of the invention includes a case for the safe enclosure and un-pressurized transport and removal/ loading of a ribbonned microphone therewith, the case comprising: an enclosure housing; an openable door on the case; a spring loaded valve connected to the door which valve opens the case to the outside ambient atmosphere during opening and closing of the door. A casing for a ribbonned microphone, the casing enclosing a ribbon therewithin, the casing comprising: a plurality of sound propagating apertures arranged through said casing enclosing the ribbon therewithin, the apertures being comprised of curved, non-cylindrical shape openings. The apertures are preferably arranged so as to be curved away from the ribbon enclosed within the casing.

Another embodiment of the invention includes a modular ribbon microphone assembly comprised of a top ribbon transducer; an intermediate matching transformer section; and a bottom amplification and electronics control section, to permit various combinations of sub-assemblies to be easily interchangeable in the assembly. Each of the sub-assemblies may have a bus bar with interconnecting pins thereon to facilitate interconnection of the sub-assemblies to one another.

Another embodiment of the invention includes a ribbon transducer for the detection of energy waves, the ribbon transducer comprising: an elongate ribbon structure comprised of electrically conductive carbon nanotube filaments, the ribbon structure arranged adjacent to a magnetic field, and wherein the ribbon structure is in electrical communication with a control circuit. The ribbon structure of carbon nanotube filaments comprises a ribbon element of a ribbon microphone. A ribbon microphone having a moving carbon-fiber-material ribbon element therein, the ribbon element comprising: an elongated layer of carbon filaments; and an elongated layer of conductive metal attached to the carbon filaments.

Another embodiment of the invention comprises: a ribbon transducer for the detection of sound waves. The ribbon transducer comprising an elongated ribbon structure comprised of electrically conductive carbon nanotube filaments arranged adjacent to a magnetic field, wherein the ribbon structure is connected to a further circuit; a ribbon microphone having a movable ribbon element comprised of a carbon nanotube material integrated therein; a ribbon microphone having a movable ribbon element comprised of a carbon fiber material integrated therein, said ribbon element comprising a layer of carbon filaments, and a layer of a conductive metal attached onto the layer of carbon filament material.

Another embodiment of the invention comprises a composite membrane acoustic transducer structure arranged adjacent a magnet assembly, the transducer structure and the magnet assembly arranged to produce a flux field; the transducer structure comprising a first layer of thin, elongate composite membrane material held under tension; a second conductive layer of membrane material attached to the first layer of composite material, wherein the first and second layers of membrane material are arranged adjacent to, generally parallel and offset from the magnet assembly, to produce the flux field through at least part of the first layer and the second layer of composite material. The first layer may be comprised of a carbon fiber. The first layer may be a polymeric material. The carbon fiber may be comprised of carbon nanotubes. The first layer is preferably electrically conductive. The second conductive layer is preferably a deposited metal. The second conductive layer may be an electroplated layer. The second conductive layer may be an electrodeposited layer.

Another embodiment of the invention comprises a method of manufacturing a membrane transducer element, comprising one or more of the following steps of: providing a form having a predetermined pattern thereon; depositing a layer of metal upon the pattern on the form to create a continuous, separate metal transducer element on the form; removing the deposited metal transducer element from the pattern, and installing the membrane transducer element adjacent to a magnetic field. The predetermined pattern may be a periodic pattern. The predetermined pattern may be aperiodic. The metal may be aluminum.

Another embodiment of the invention comprises a method of manufacturing a ribbon type acoustic element to a specific frequency comprising: one or more of the following steps: axially mounting an acoustic element in a holder having a movable mounting point for supporting the acoustic element; moving the mounting point to vary the tension of the acoustic element, and resonating the acoustic element to a predetermined frequency. The acoustic element may be a metal element. The acoustic element preferably comprises a transducer assembly.

BRIEF DESCRIPTION OF THE DRAWINGS

The objects and advantages of the present invention will become more apparent when viewed in conjunction with the following drawings, in which.

DETAILED DESCRIPTION OF THE PREFERRED EMBODIMENTS

Figure 2:
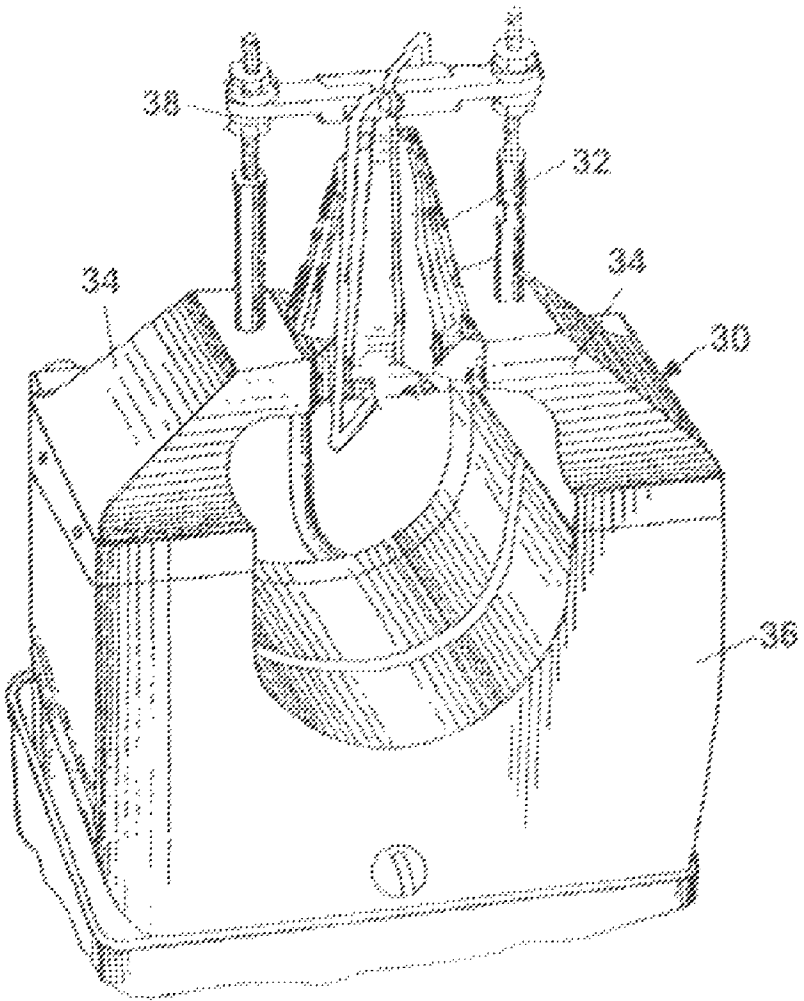
Fig. 2 (PRIOR ART)
FIG. 2 represents a prior art ribbon microphone transducer showing its corrugated ribbon suspended between tapered, ferrous pole pieces extending from a permanent magnet.
Figure 1:
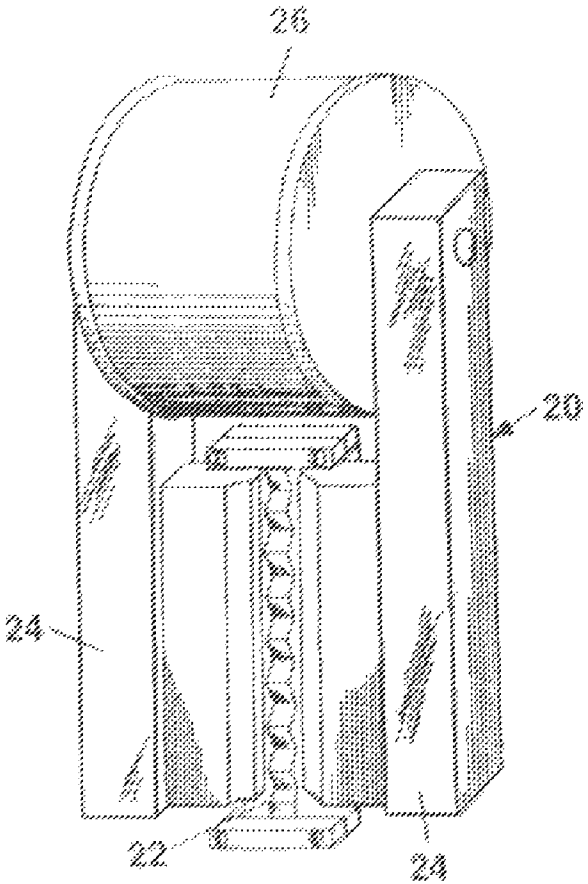
Fig. 1 (PRIOR ART)
FIG. 1 represents a prior art ribbon microphone transducer showing a corrugated ribbon suspended between ferrous poles extending from an electromagnet.

Referring now to the drawings in detail, and particularly to FIG. 1, there is represented a typical prior art ribbon microphone transducer 20, from U.S. Pat. No. 1,885,001 to Olson and incorporated herein by reference, shows a corrugated ribbon 22 suspended between ferrous poles 24 extending from an electromagnet 26. The electromagnet 26 establishes the magnetic field, which is carried through the pole pieces 24 and into proximity with the sound-responsive ribbon 22. When the ribbon 22 is vibrated by incoming sound waves, an electrical current is generated in the ribbon 22 which may then be amplified, recorded or transmitted. A typical prior art ribbon microphone transducer 30 shown in FIG. 2, as may be seen more completely in U.S. Pat. No. 3,435,143 to Fisher, incorporated herein by reference, illustrates the corrugated ribbon 32 suspended between tapered, ferrous pole pieces 34 extending from a permanent magnet 36. The tapered pole pieces 34 reduce the path length between the front of the ribbon and the back of the ribbon, which improves high frequency response. The ribbon is suspended in an adjustable frame 38 with screw and nut adjustments that may be used for fine tuning the position of the ribbon 32.

Figure 3:
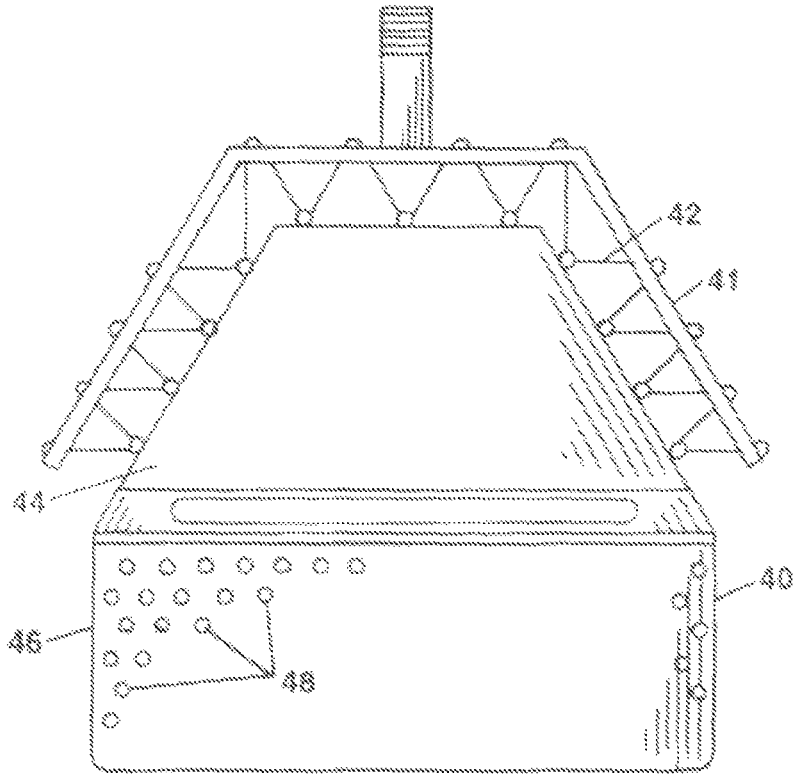
FIG. 3 is a side elevational view of the present invention showing a microphone casing having a suspension system therewith.
Figure 4:
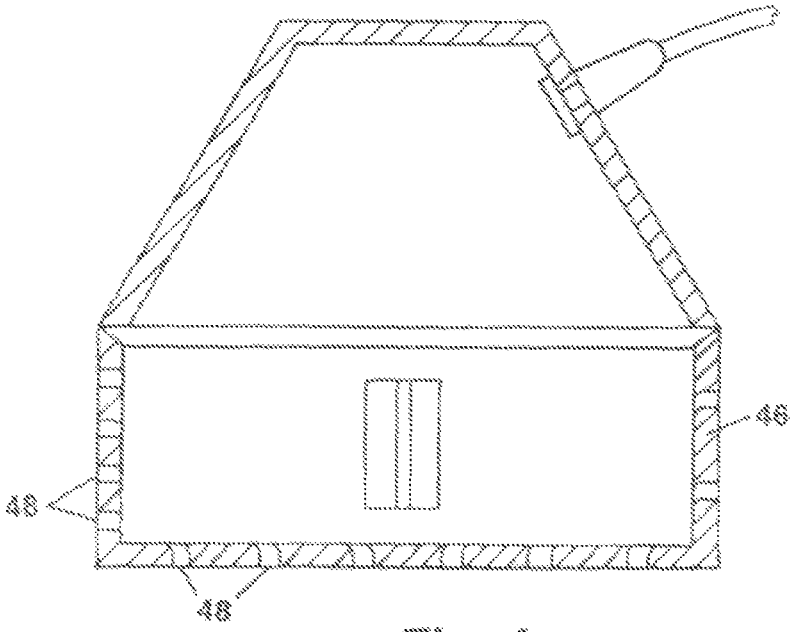
FIG. 4 is a cutaway view of the microphone casing shown in FIG. 3.
Figure 5:
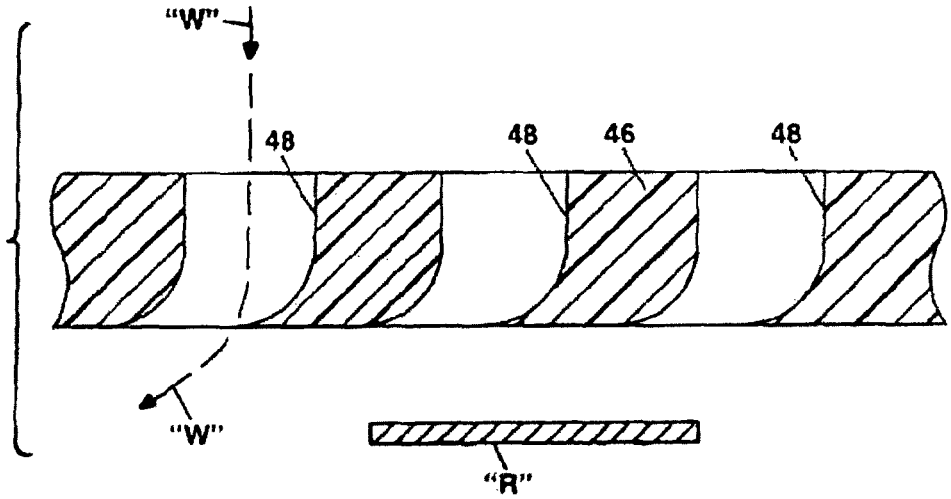
FIG. 5 is an enlarged sectional view of the casing of the present invention showing an aperture arrangement therewith.

Improvements in such prior microphone art are however, represented in FIG. 3, wherein a microphone casing 40 is shown having a suspension system 41 consisting of a zig-zag arrangement of elastomeric cords or cables 42, a tapered body shell arrangement 44, and a sound screen 46 having a multiplicity of apertures 48 for sound to propagate through, while preventing ingress of foreign objects, dirt, and the like. The cutaway view of FIG. 4 shows the microphone casing 46 showing a plurality of spaced-apart apertures 48 therethrough, each aperture 48 having an axially curved, non-cylindrical, non-linear shape. FIG. 5 shows an enlarged view of the apertures 48, representing how air blasts "W" may be directed away from a nearby ribbon "R" under conditions of a high velocity wind. Such redirection of strong fluid currents may be attributed to the Coanda effect whereby laminar flow of fluids over curved surfaces is effective to change the direction of flow to conform to those surfaces. Apertures 48 shaped with non linear profiles as shown in FIG. 5 may allow ordinary vibratory sound waves to enter relatively unimpeded while potentially destructive air blasts are however, directed away from a delicate sound pickup device such as the ribbon "R", or other transducer.

Figure 6:
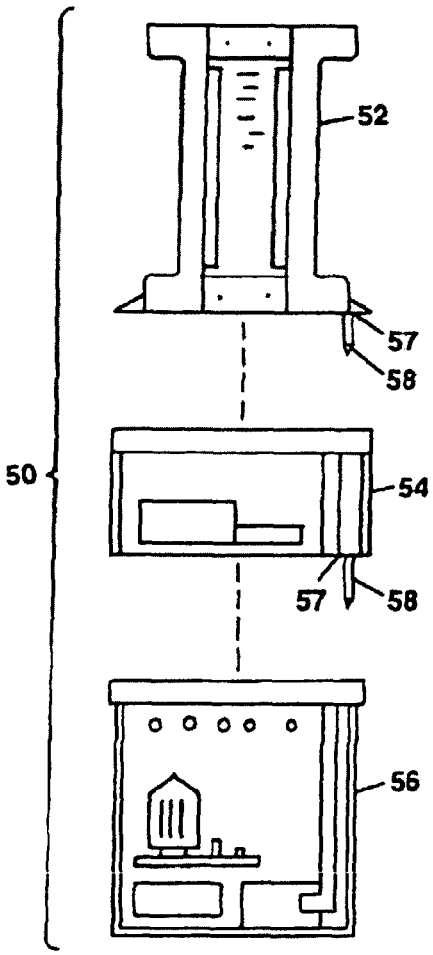
FIG. 6 is an exploded, sectional view from the side of a modular ribbon microphone assembly constructed according to the principles of the present invention.
Figure 7:
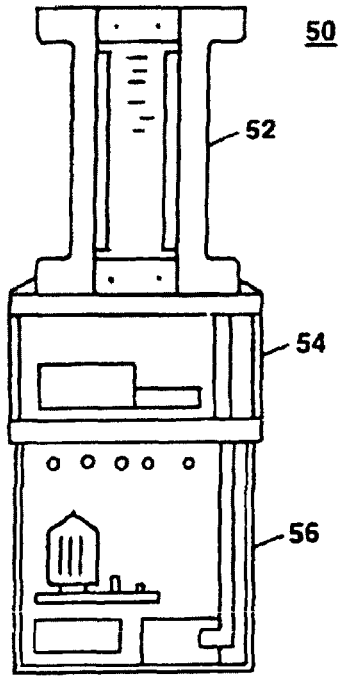
FIG. 7 represents a side elevational view of an assembled stack of transducer, transformer, and electronics modules represented in the exploded view of FIG. 6.

FIG. 6 displays an exploded representation of a modular ribbon microphone assembly 50 comprised of a top ribbon transducer 52, an intermediate matching transformer section 54, and a bottom amplification and electronics control section 56, thus allowing different varieties of ribbon microphone systems to be user-configured. Direct interconnecting pins 58 extending from bus bars 57 are used to interconnect each section 52, 54, and 56 to one another. Users of microphones often wish to interchange components in the audio chain to adjust different sonic and electronic attributes such as gain, frequency response, timbre, distortion and the like. The use of a matched, modular setup has been used in prior art condenser microphones but not in ribbon microphones, because ribbon microphone construction prior to the present invention has not been consistent in gain, frequency response, timbre or distortion. FIG. 7 represents the assembled stack of transducer, transformer, and electronics modules 52, 54 and 56. Straight bus bars 57 are utilized connect the motor to transformer unit, and transformer unit to amplifier/connector unit. The straight, preferably in-line fixed position interconnects afford a greater degree of control of hum pickup from external fields, in contrast to circuitous wired connections. Wire connections are often manipulated for lowest hum pickup due to the variable nature of flexible wires. The use of rigid interconnecting members 58 virtually eliminates this variable, while at the same time assuring a low resistance, low noise connection. The use of silver bars or copper plated with silver provides low resistance and low noise. Thermal noise generated within the conductor is also minimized by the use of thick conductors and silver metal. Generally there are three sections of prior art ribbon microphones that contribute to the overall thermal noise and other noise floor produced by the completed microphone assembly. These include the ribbon, the interconnections, and the transformer sections. The use of heavy conductors in both the transformer and the interconnecting sections is desirable. The ribbon must be a light conductor out of necessity, yet improvements to that portion are also possible.

Figure 8:
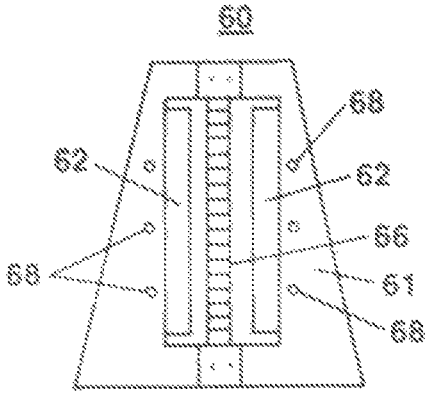
FIG. 8 is a side elevational view of a tapered transducer featuring a surrounding flux frame that positions two or more adjacent magnets in proximity to a suspended ribbon mounted therebetween.

One preferred embodiment of a transducer 60 is shown in FIG. 8. It is a tapered transducer 60 featuring a surrounding flux frame 61 that positions two or more adjacent magnets 62 in proximity to an elongated, formed, preferably multilayered, suspended ribbon 66 mounted therebetween. The tapered flux frame 61 shortens the acoustic distance from the front to the back of the ribbon 66 to improve high frequency response in the shortened area, and reduces the abruptness of any high frequency cutoff effect that is characteristic of "parallel" sided flux frames. The flux frame 61 is equipped with ring-receiving apertures 68 near the position of the magnets 62 extending through the flux frame 61. The apertures 68 are positioned to receive curved return rings, (shown for example, as members 72 in FIGS. 9 and 9A) which are used to create a return path for the magnetic flux. This increases the strength of the magnetic field in the gap where the ribbon 66 is positioned and results in a more efficient conversion of sound energy into electrical energy. This efficiency improvement increases overall output and sensitivity, which is a desirable attribute of high quality microphones. The return rings 72 are shaped, with a cross-section that is small with respect to incoming sound waves at any angle. This shape reduces reflections and undesired internal resonance. The overall small cross-section of the return rings 72 reduces blocking or attenuation of the sound energy yet permits sound energy to arrive unhindered at the ribbon 66, while performing flux carrying duty.

Figure 9:
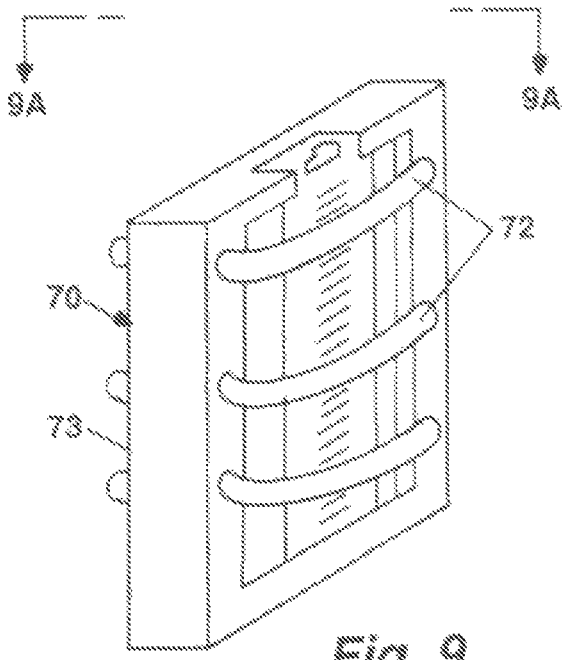
FIG. 9 is a perspective view of a non-tapered (parallel sided-walls) transducer of the present invention showing installed return rings.
Figure 9A:
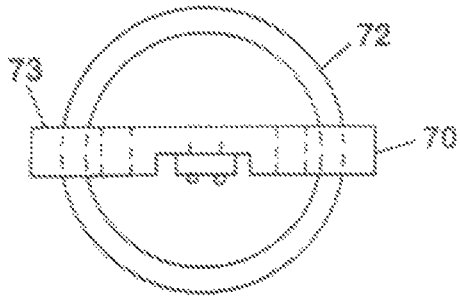
FIG. 9A is a view taken along the lines 9A-9A of FIG. 9.

FIGS. 9 and 9*a* show a non-tapered, generally parallel-walled transducer 70 with the installed arrangement of return rings 72. There may be as few as one return ring 72, or many, depending upon the length of the transducer and the amount of magnetic reinforcement/recirculation that is desired. The return rings 72 may be inserted via press fit into the thickness of the flux frame 73 to enhance coupling of the magnetic field thereto, or they may be attached to the flux frame 73 by welding.

Figure 10:
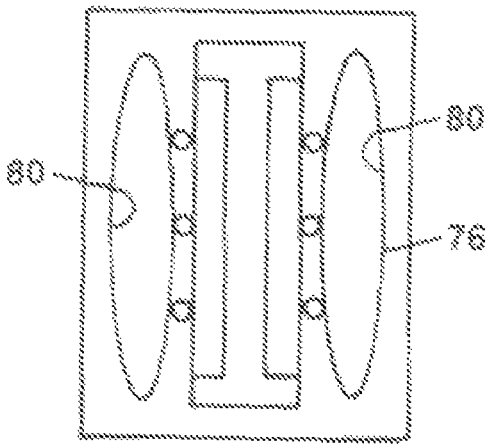
FIG. 10 is a side elevational view of a flux frame of the preset invention showing features of both the tapered and non-tapered embodiments.

A further transducer embodiment is shown in FIG. 10 with a flux frame 76 having the features of both the tapered and non-tapered styles, having further side apertures 80 to shorten the distance from the front to the back of the ribbon. The use of side apertures 80 is known to improve high frequency response in ribbon microphones. The use of large, elongated curvilinear/circular side apertures 80 in conjunction with the use of tapered assemblies allows magnetic field strength to be preserved.

Figure 11A:
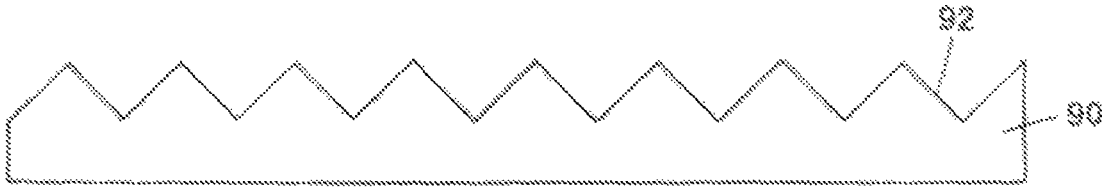
FIG. 11*a* is a cross-sectional view of a ribbon form of the present invention, having a predetermined "ribbon-forming" pattern on that form.
Figure 11B:
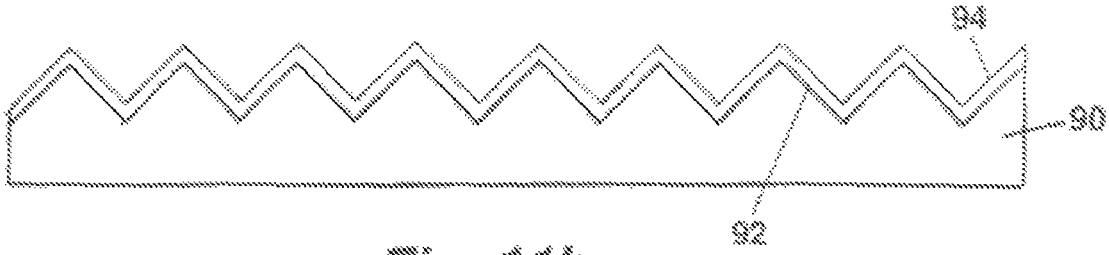
FIG. 11*b* is a cross-sectional view of a ribbon form shown in FIG. 11*a*, having a deposited layer of metal thereon, such as for example, aluminum.

FIG. 11*a* represents a cross section view of a ribbon form 90 having a predetermined ribbon-shaping surface pattern 92. The form 90 may be made from a wax or dissolvable material which may support vapor deposition of metals, such as aluminum thereon, or the plating of such metals. FIG. 11*b* represents a cross section view of a ribbon form 90 having a deposited layer of aluminum 94. The aluminum thickness may generally be from about ¼ micron to up to about 4 microns. More than one layer (not shown) may be deposited on the surface 92 of the form 90. The layers may be of the same materials or of different materials having different mechanical and electrical properties. For instance, a first layer of gold may be deposited, followed by a second layer of thicker aluminum and then a third gold layer or mixed combinations thereof. The gold layers may be very thin, in the order of a few hundred nanometers. The aluminum layer may be from 500 nm to about 3000 nm, more or less, depending upon the size required, the amount of conductivity desired, and the total mass allowed in the design.

Generally, high mass ribbons require greater amounts of sound energy to be vibrated within the magnet gap, while lower mass ribbons require less, so it is desirable to keep mass to a minimum. However, too-thin materials, such as aluminum, become increasingly resistive however, as the cross section decreases. The tradeoff between resistance and mass has long been a limiting factor in ribbon microphone design, as has the tradeoff between strength and mass. The use of composite materials, layered materials and highly conductive materials as taught herein affords a greater design latitude and improved performance.

Figure 11C:
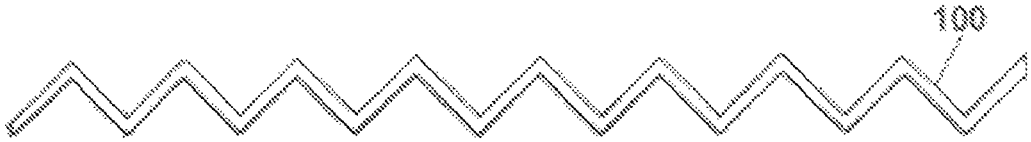
FIG. 11*c* is a side elevational view of the completed ribbon after removal of that metal ribbon from the form shown in FIG. 11*a;*
Figure 11D:
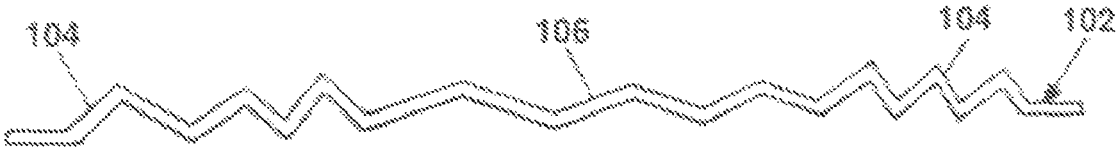
FIG. 11*d* is a cross-sectional view of a completed ribbon produced by the process of deposition, the ribbon having a predetermined pattern thereon.

FIG. 11*c* represents, for example, an edge view of a completed ribbon 100 after removal from the form 90. The metal ribbon 100 is strong and does not have fractures or stresses, nor will it tend to relax. Prior art ribbons are formed by bending and/or distorting a flat sheet, which compromises the tensile strength and leaves residual forces which may cause the ribbon to relax over time. FIG. 11*d* represents an edge view of a completed ribbon 102 produced by the process of deposition on a form, having a predetermined pattern. The pattern may be periodic, aperiodic, or graduated so that smaller, shorter waves portions or undulations 104 are placed near the ends of the ribbon 102, and the flatter portions 106 are arranged near the middle of the ribbon 102. Due to the precise and conformal nature of the deposition process, fine details such as letters (not shown) or features such as longitudinal ribs (not shown) may be produced to mark or stiffen certain planar or surface portions of the ribbon 102.

Figure 11E:
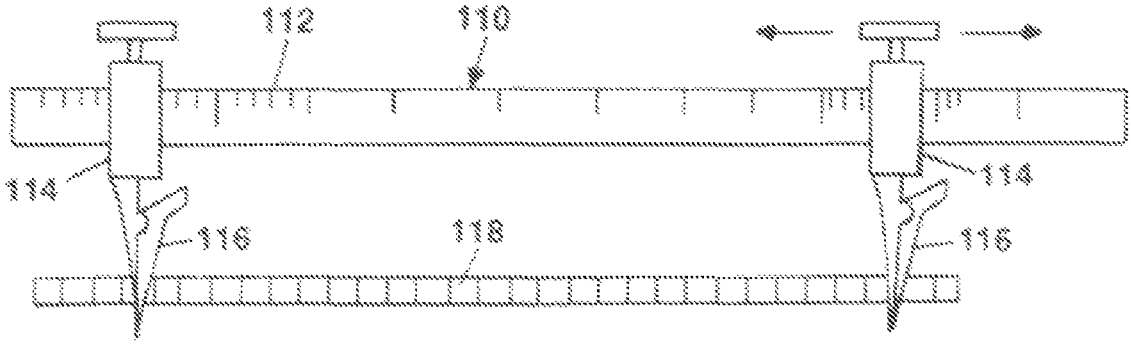
FIG. 11*e* shows a side elevational view of a graduated fixture having a scale, movable slides, and clips to hold a microphone ribbon therebetween.
Figure 11F:
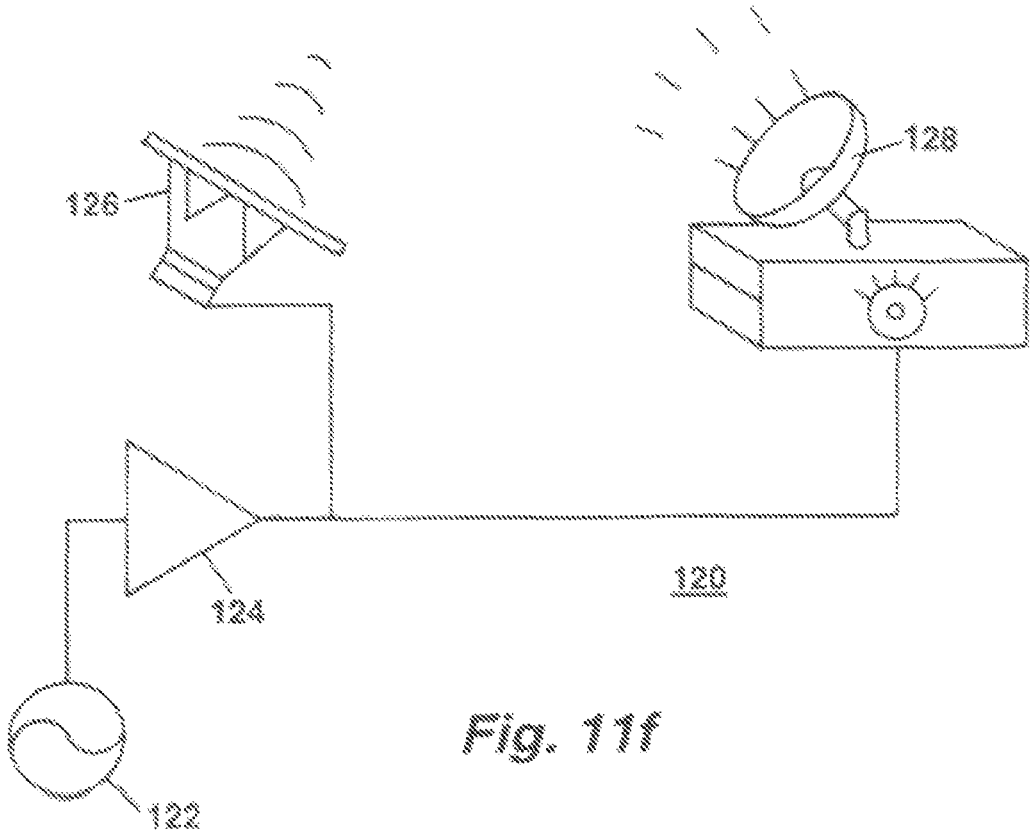
FIG. 11*f* is a schematic representation of a tuning system to be used with the graduated ribbon-holding fixture shown in FIG. 11*e;*

FIG. 11*e* shows an example of a graduated fixture 110 having a scale 112, movable slides 114, and clips 116 to hold a ribbon 118 to be adjusted. The FIG. 11*f* discloses a schematic representation of a tuning system 120 to be utilized with the graduated fixture 110 of FIG. 11*e*. A variable frequency oscillator 122 may be connected to an amplifier 124 which drives a loudspeaker 126 and triggers a strobe light 128 in synchronization with the oscillator 122. The oscillator 122 is set to the desired resonant frequency of the ribbon 118 and the clips 116 are moved until maximum excursion of the ribbon 118 is observed, indicating a resonance peak of the ribbon 118, shown in FIG. 11*e*. The strobe light 128 aids in the observation of the peak and also any other resonant modes, including out-of-phase modes, which may lead to distortion. The ribbon 118 may be precisely tensioned using the combination of the apparatus 110 shown in FIG. 11*e* and the apparatus 120 and procedure therewith, represented by FIG. 11*f*, and then installed into a transducer assembly when properly tuned. The ribbon 118 may then be connected to a further circuit load, such as a transformer, and subsequent amplifier, during the tuning process if desired. This fine and precise adjustment of the ribbon 118 improves the unit-to-unit consistency of assemblies which is very desirable.

Figure 12A:
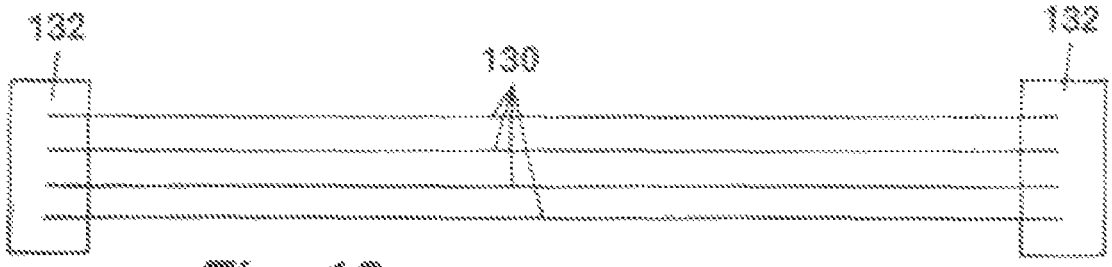
FIG. 12*a* is a plan view of a series of filaments suspended between a pair of filament holders useful in the manufacture of microphone ribbons.
Figure 12B:
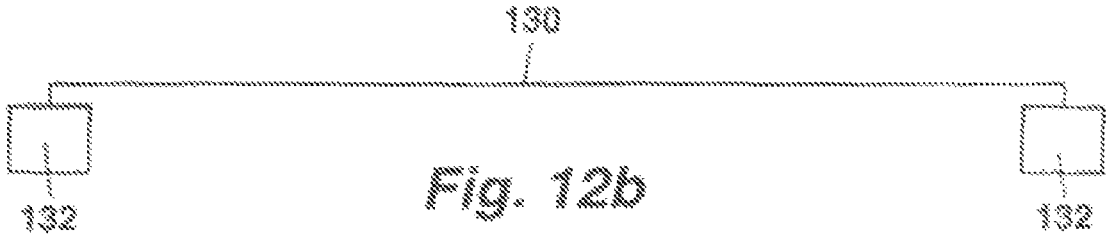
FIG. 12*b* is a side elevational view of the series of ribbon filaments shown in FIG. 12*a;*
Figure 12C:
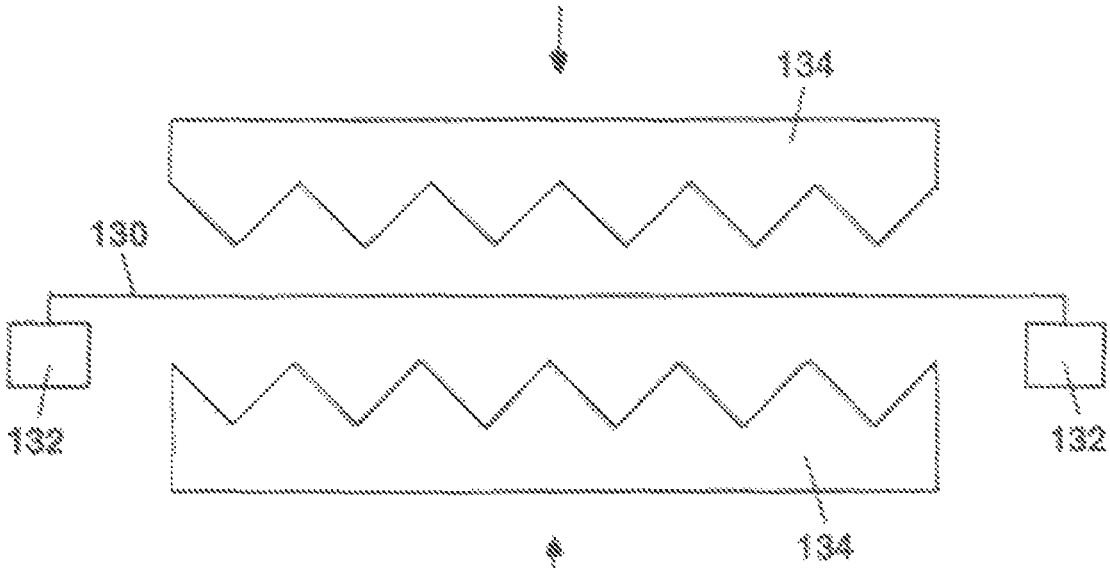
FIG. 12*c* is a side elevational view of the series of filaments in spaced proximity between a pair of forms which may be utilized to apply pressure, heat, or both.
Figure 12D:
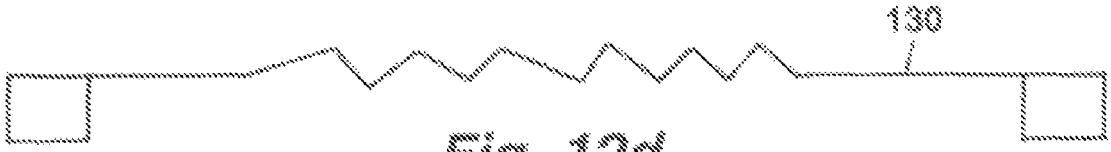
FIG. 12*d* is a side view of the series of filaments after being impressed with the shape of the forms shown in FIG. 12*c;*

The view shown in FIG. 12*a* is a plan view of a series of filaments or fibers 130 suspended between a set of fiber holders 132. The fibers 130 may be made of a high tensile strength polymeric material such as Kevlar which does not stretch or shrink. The fibers 130 may also be comprised of a carbon nanotube fiber, ribbon or composite having high tensile strength and low mass. For example, such a carbon nanotube ribbon may be conductive or super-conductive. FIG. 12*b* is a side view of the series of filaments 130 shown in, FIG. 12*a*. FIG. 12*c* shows a side view of the series of filaments in proximity to a pair of patterned forms 134 which may apply pressure, heat, or both. The view of FIG. 12*d* is a side view of the series of filaments 130 after being impressed with the shape of the forms 134. The series of filaments 130 may be further coated, plated or covered using a deposition process, such as a vapor deposition process, not shown for clarity. The deposited material may be aluminum or other conductive material such as gold. Multiple materials may be used including alloys having superconducting properties. Such alloys are generally stiff and hard to form into wire, yet may be suitably formed in a practical manner by the method described. The advantage of using such a superconducting or very highly conducting alloy is an ability to produce a strong, low mass ribbon without reducing the conductivity to the point where microphone output drops to an unacceptable degree. Superconducting alloys may have sufficient tensile strength to be used alone in this application. Carbon nanotubes or carbon fibers, or ribbons, may have sufficient conductivity, strength, and low enough mass, to be used in this application with the advantage of improved toughness, resistance to long term distortion, sagging, or damage. Very strong, low mass, and highly conductive layered ribbons may now be constructed using these new techniques, (such multi-layering may done for example, by bonding, adhesive, deposition, or other adhesion processes).

Figure 13A:
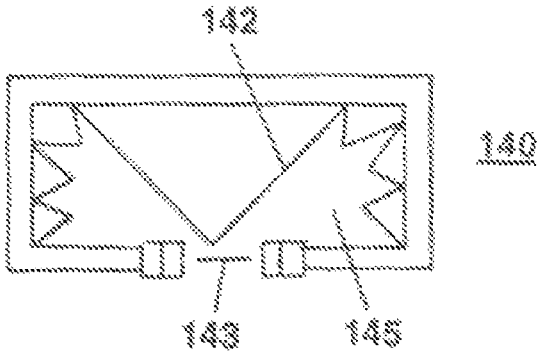
FIG. 13*a* is a plan view of a ribbon assembly with a sound absorbing wedge placed a spaced distance from one side, in this case the rear of the ribbon.
Figure 13B:
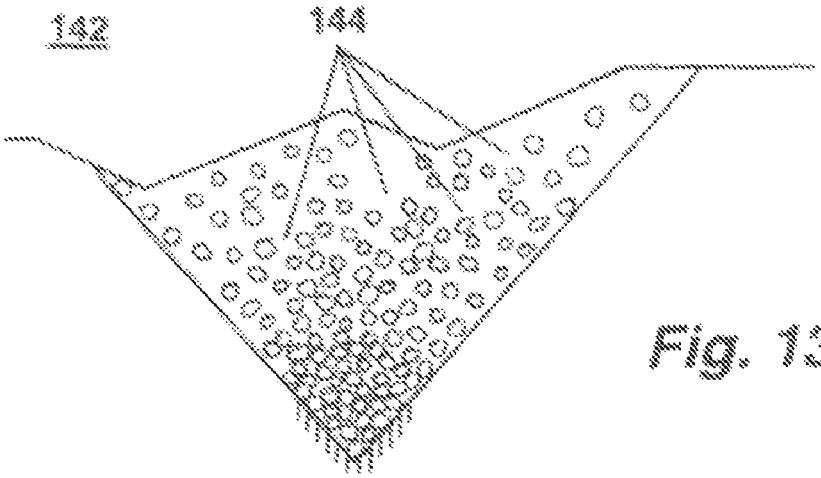
FIG. 13*b* is a detailed side elevational view of the sound absorbing wedge as shown in FIG. 13*a;*

In FIG. 13*a*, there is shown is a top view of a ribbon assembly 140 with a sound absorbing wedge 142 placed a spaced distance from one side, in this case the rear of the ribbon 143. The sound absorbing wedge 142 is effective to absorb and attenuate sound energy arriving from the rear of the microphone. Ribbon microphones without sound absorbers exhibit a dipolar, "FIG. 8" reception pattern. Monopolar, or unidirectional ribbon operation is sometimes desired. The back of the ribbon is sealed so that sound energy does not arrive at the ribbon from the rear. The wedge 142 absorbs reradiated sound produced by the moving ribbon. The shape of the wedge 142 reduces specular reflection back to the ribbon, which is undesirable. Multiple wedges may be used. The wedges may be enclosed to define a chamber 145 having one opening facing the ribbon 143. In FIG. 13*b* there is shown a detailed view of the sound absorbing wedge 142 showing a heterogeneous structure. The heterogeneous structure is comprised of filaments, open cell foams, and closed cell foams 144, each having a directionally-formed increasing density and acoustic impedance to sound, which increase in loss in the form of heat without producing reflections from the front surface, which is at or near the acoustic impedance of air. This construction allows lower frequencies to be absorbed at a greater rate than would otherwise be possible with homogeneous materials such as common foams.

Figure 14:
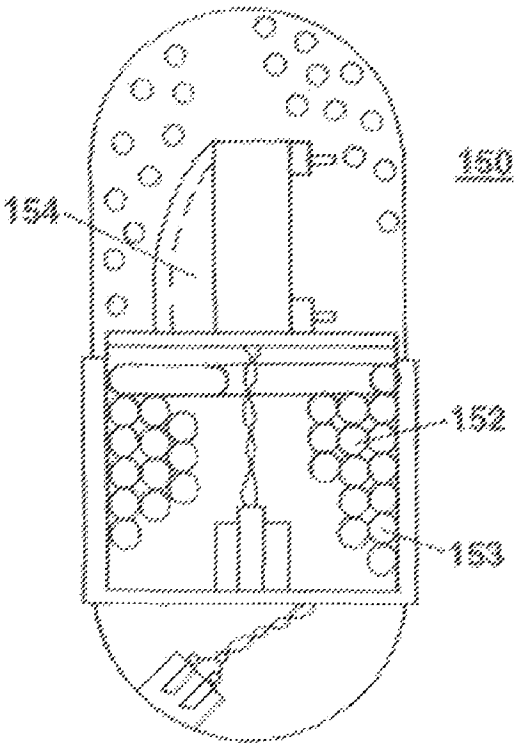
FIG. 14 is a side elevational view, in section, of a microphone assembly having back lobe suppression therewith.

FIG. 14 is an example, in a cross section view, of a microphone assembly 150 having "back lobe" suppression. An acoustic labyrinth 152 may be produced using rolled or coiled tubing 153 such as plastic tubing, Tygon™, or other coilable, formable generally tubular materials. The formable tubular materials may be arranged in any formation so as to fit within the housing of the microphone 150. Back chamber (as described partially in FIG. 13*a*) may be connected to the acoustic labyrinth which may be positioned at or below the transducer assembly 154, or around internal structures or components such as a transformer. The tubing 153 may be filled with a lossy, sound absorbing material such as injected, open cell foam of urethane, or filled with a loose, sound absorbing fibrous material such as nylon, or aerogels. The length of the tube is generally about 30" as described in the prior art for acoustic labyrinth construction using machined ports or chambers which are more difficult to produce and do not offer positioning options of a flexible tube. One end of the tube may be attached to the chamber of FIG. 13*a* so that a continuous seal of air from the back of the ribbon 143 through the entire length of the tube 153 may be maintained. Such an arrangement provides a convenient and repeatable construction of a unidirectional ribbon microphone system which works as a pressure transducer.

Figure 15A:
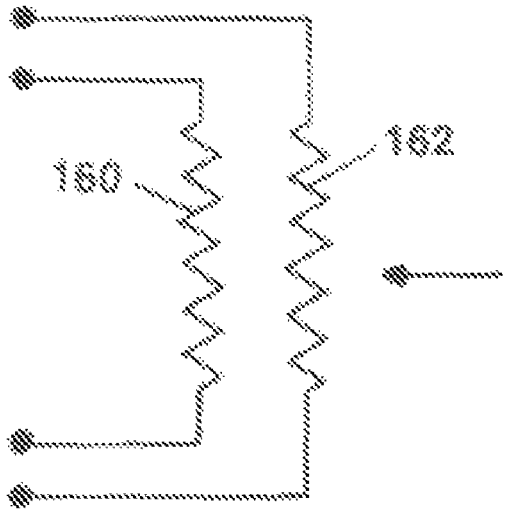
FIG. 15*a* shows an electrical schematic diagram of a pair of identical ribbons of the present invention arranged in a parallel circuit configuration.
Figure 15B:
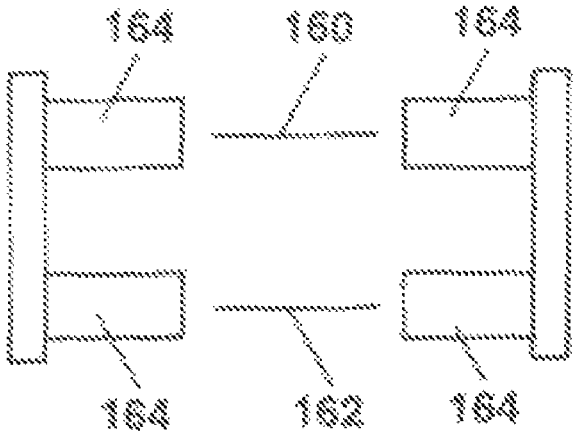
FIG. 15*b* shows a plan view of the pair of identical ribbons in proximity to each other and each within gaps of adjacent magnets.
Figure 15C:
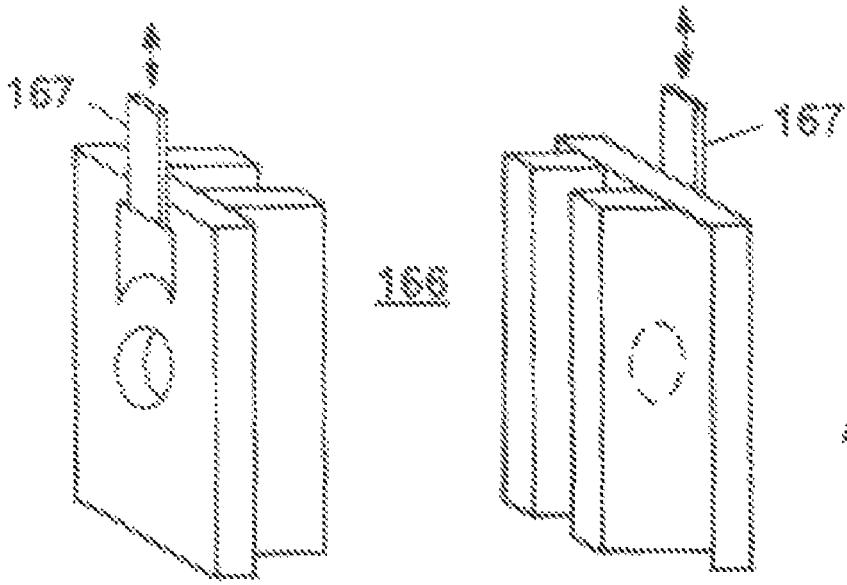
FIG. 15*c* is a perspective view of a practical holder for a pair of adjacent magnets.

FIG. 15*a* discloses an electrical schematic diagram of a pair of identical ribbons 160 and 162 produced using the teachings herein, arranged in parallel circuit configuration. FIG. 15*b* is a top view of the pair of identical ribbons 160 and 162 in proximity to each other and each within gaps of adjacent magnets 164. FIG. 15*c* shows a perspective view of a practical holder 166 for the adjacent magnets 164 shown in FIG. 15*b*. The holder 166 controls the amount of air or sound waves from entering the space between the ribbons (160 and 162) using sliding aperture stops 167 or other adjustable door means. The use of two identical ribbons (i.e. 160 and 162) allows variable patterns to be produced using ribbon elements within the space of one microphone without excessive distortion due to the identical and repeatable nature of the ribbon elements when produced using improved ribbon and microphone construction methods such as deposition, synchronized tuning, and filamentous or carbon nanotube ribbon construction.

Figure 16A:
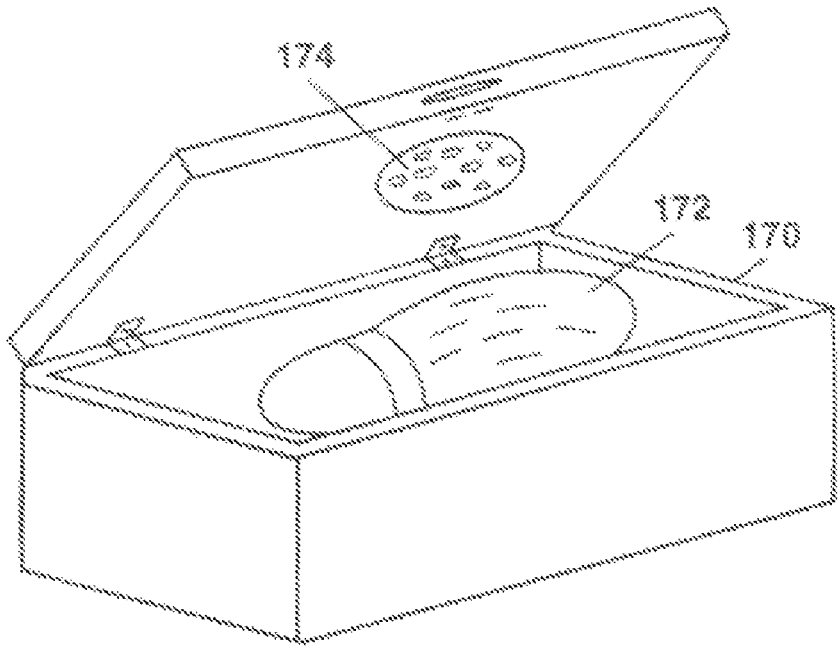
FIG. 16*a* shows a perspective view of a storage and travel case for a pressure sensitive device such as a ribbon microphone.
Figure 16B:
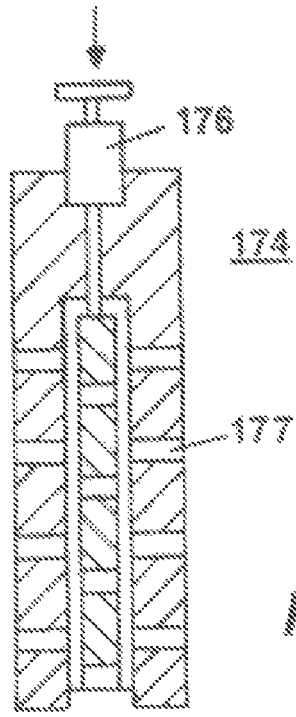
FIG. 16*b* is a cross sectional view of an air escape valve utilizable in the travel case represented in FIG. 16*a*.

A storage and travel case 170 is shown in FIG. 16*a*, for a pressure sensitive device such as a ribbon microphone 172. Prior art boxes generally have a lid which may be closed or opened suddenly. Such sudden unprotected operation as the opening or closing of the case may produce undesired pressures that may damage the contents. An air valve 174 is connected to latch (or hinge) so that there is an escape path for air pressure during the opening and closing procedure. FIG. 16*b* shows a cross section view of an air escape valve 174. A spring loaded plunger 176 may be incorporated into the latch to release air through discharge openings 177 prior to opening. The area of the valve 174 is large relative to the case 170 so that undesired pressure cannot build up, even momentarily.

Figure 17:
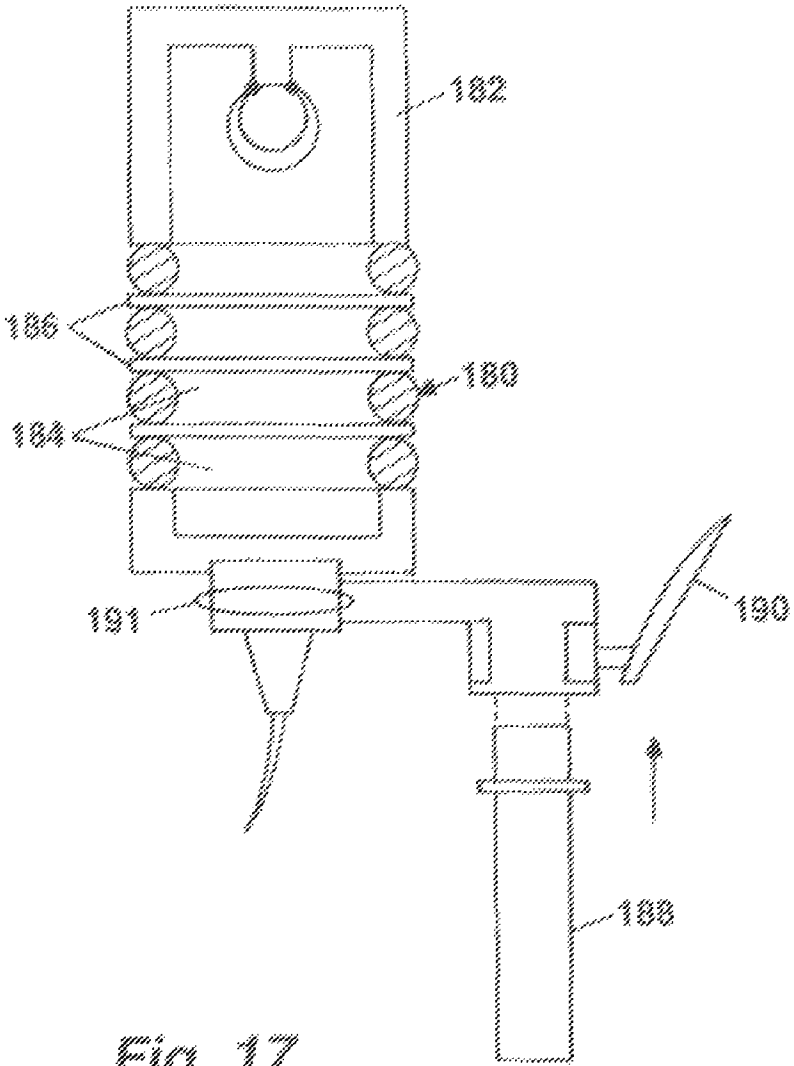
FIG. 17 is a side elevational view, in cross section, of a sound absorbing structure integrated into the body of a microphone.

An exemplary microphone support 180 is shown in FIG. 17 in a cross sectional view of a sound absorbing structure integrated into the body of a microphone 182. A plurality of annular rings 184 are preferably interposed with acoustically lossy materials 186 such as filled low durometer urethanes. The alternating series of lossy segments assures little propagation of noise from the microphone stand 188, up into the microphone head. The flat, annular ring arrangement allows reasonably rigid and compact microphone body to be safely maintained while assuring a high area of sound absorbance. A clamp 190 may be attached firmly to the microphone body base 191, but is isolated from head, reducing or eliminating sound propagation from the stand into the microphone 182.

I claim:

1. A method of manufacturing a membrane transducer element, comprising:

providing a form comprising a first form half and a second form half, the first form half and the second form half each having a corresponding predetermined pattern thereon;

depositing a layer of metal upon said form and wherein the layer of metal is sandwiched between the first form half and the second form half to create a continuous, separate metal transducer element on said form corresponding to the predetermined pattern on the first form half and the second form half; and installing said membrane transducer element adjacent to a magnetic field.

2. The method of manufacturing a membrane transducer element as recited in claim 1, wherein said predetermined pattern is a periodic pattern.

3. The method of manufacturing a membrane transducer element as recited in claim 1, wherein said predetermined pattern is aperiodic.

4. The method of manufacturing a membrane transducer element as recited in claim 1, wherein said layer of metal is aluminum.

5. A method of forming a transducer element in a form having a predetermined pattern thereon, comprising:

depositing a material on the predetermined pattern on the form to create a continuous, separate transducer element on the form in the shape of the predetermined pattern on the form; and wherein the form comprises a first form half and a second form half, the first form half and the second form half each having the predetermined pattern thereon. wherein the material is sandwiched between the first form half and the second form half.

6. The method according to claim 5, wherein the material comprises a first and second layer, wherein the first layer is deposited on the pattern and the second layer is deposited on the first layer.

7. The method according to claim 6, wherein the material comprises a third layer, wherein the third layer is deposited on the second layer.

8. The method according to claim 7, wherein the first, second, and third layers comprise one of aluminum, gold, and a combination thereof.

9. The method according to claim 6, wherein the second layer is thicker than the first layer.

10. The method according to claim 5, wherein said predetermined pattern is a periodic pattern of undulations.

11. The method according to claim 5, wherein said predetermined pattern is an aperiodic pattern of undulations.

12. The method according to claim 5, wherein the form is made of a dissolvable material.

13. The method according to claim 5, wherein the form is made of a wax material.

14. A method of manufacturing a ribbon for a transducer comprising: providing a form having a predetermined ribbon pattern;

depositing a first layer of ribbon forming material on the predetermined ribbon pattern;

depositing a second layer of ribbon forming material on the first layer of ribbon forming material;

wherein the first and second layers of ribbon forming material are metal; and wherein the form comprises a first form half and a second form half, each half having the predetermined ribbon pattern thereon and wherein the first and second ribbon forming materials are sandwiched between the first form half and the second form half.

15. The method according to claim 14, wherein a third layer of ribbon forming material is deposited on the second layer of ribbon forming material.

16. The method according to claim 14, wherein the predetermined pattern is one of a periodic pattern and an aperiodic pattern of undulations.

17. The method according to claim 14, wherein the first and second forms are one of wax and a dissolvable material.

* * * * *